US010444687B2

(12) United States Patent
Sasami

(10) Patent No.: US 10,444,687 B2
(45) Date of Patent: Oct. 15, 2019

(54) IMAGE FORMING APPARATUS

(71) Applicant: KONICA MINOLTA, INC., Chiyoda-ku, Tokyo (JP)

(72) Inventor: Shingo Sasami, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/160,392

(22) Filed: Oct. 15, 2018

(65) Prior Publication Data

US 2019/0121273 A1 Apr. 25, 2019

(30) Foreign Application Priority Data

Oct. 20, 2017 (JP) ..... 2017-203215

(51) Int. Cl.
*G03G 15/00* (2006.01)

(52) U.S. Cl.
CPC ..... *G03G 15/5029* (2013.01); *G03G 15/652* (2013.01); *G03G 15/6517* (2013.01); *G03G 15/6564* (2013.01); *G03G 15/5062* (2013.01); *G03G 2215/00721* (2013.01); *G03G 2215/047* (2013.01)

(58) Field of Classification Search
CPC ..... G03G 15/5029; G03G 15/6517; G03G 15/6564; G03G 15/652; G03G 2215/047; G03G 2215/00721; G03G 15/5062
See application file for complete search history.

(56) References Cited

U.S. PATENT DOCUMENTS 9,122,220 B2 9/2015 Numazu

FOREIGN PATENT DOCUMENTS

| | | | |
|---|---|---|---|
| JP | 2006225128 A | | 8/2006 |
| JP | 2006240025 A | | 9/2006 |
| JP | 2008000902 A | * | 1/2008 |
| JP | 2013184324 A | | 9/2013 |
| JP | 2014052433 A | | 3/2014 |
| JP | 2017161796 A | | 9/2017 |

OTHER PUBLICATIONS

Extended European Search Report (EESR) dated Mar. 25, 2019 issued in counterpart European Application No. 18201264.1.

* cited by examiner

*Primary Examiner* — Susan S Lee
(74) *Attorney, Agent, or Firm* — Holtz, Holtz & Volek PC

(57) ABSTRACT

An image forming apparatus includes: a conveyer that conveys continuous paper through a conveying path; a detector that detects a mark on the continuous paper conveyed by the conveyer; an image former that is provided on a subsequent stage side of the detector and forms an image on the continuous paper; and a hardware processor that causes the image former to start forming an image according to a position setting for forming an image on the continuous paper using the image former after a mark on the continuous paper is detected, wherein the hardware processor adjusts the position setting on the basis of a start position determined according to an image formation state.

9 Claims, 8 Drawing Sheets

IMAGE FORMING APPARATUS

The entire disclosure of Japanese patent Application No. 2017-203215, filed on Oct. 20, 2017, is incorporated herein by reference in its entirety.

BACKGROUND

Technological Field

The present disclosure relates to an image forming apparatus.

Description of the Related Art

An image forming apparatus has been widely used in recent years. In a case of printing images on continuous paper using the image forming apparatus, it is required to keep image intervals on the continuous paper constant to efficiently perform various kinds of processing. Accordingly, a process in which a mark is formed on the continuous paper and an image is formed on the continuous paper according to detection of the mark has been performed (see JP 2006-225128 A and JP 2014-052433 A, for example).

However, in a method of printing in which an image is fixed onto the continuous paper by heat, there may be a risk that the continuous paper shrinks through the fixing operation due to shrinkage caused by heat. In the conventional technique as disclosed in JP 2006-225128 A and JP 2014-052433 A, an image is formed in an adjacent image formation scheduled region on the basis of a mark corresponding to an image having already been formed. Therefore, in the conventional technique as disclosed in JP 2006-225128 A and JP 2014-052433 A, an image is formed in the adjacent image formation scheduled region set before the fixing operation on the basis of a position shrunk after the fixing operation, whereby there may be a risk that an image cannot be formed at an appropriate position.

SUMMARY

The present disclosure has been conceived in view of such a situation, and an object of the present disclosure is to enable formation of an image at an appropriate position.

To achieve the abovementioned object, according to an aspect of the present invention, an image forming apparatus reflecting one aspect of the present invention comprises: a conveyer that conveys continuous paper through a conveying path; a detector that detects a mark on the continuous paper conveyed by the conveyer; an image former that is provided on a subsequent stage side of the detector and forms an image on the continuous paper; and a hardware processor that causes the image former to start forming an image according to a position setting for forming an image on the continuous paper using the image former after a mark on the continuous paper is detected, wherein the hardware processor adjusts the position setting on the basis of a start position determined according to an image formation state.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

Figure 1:
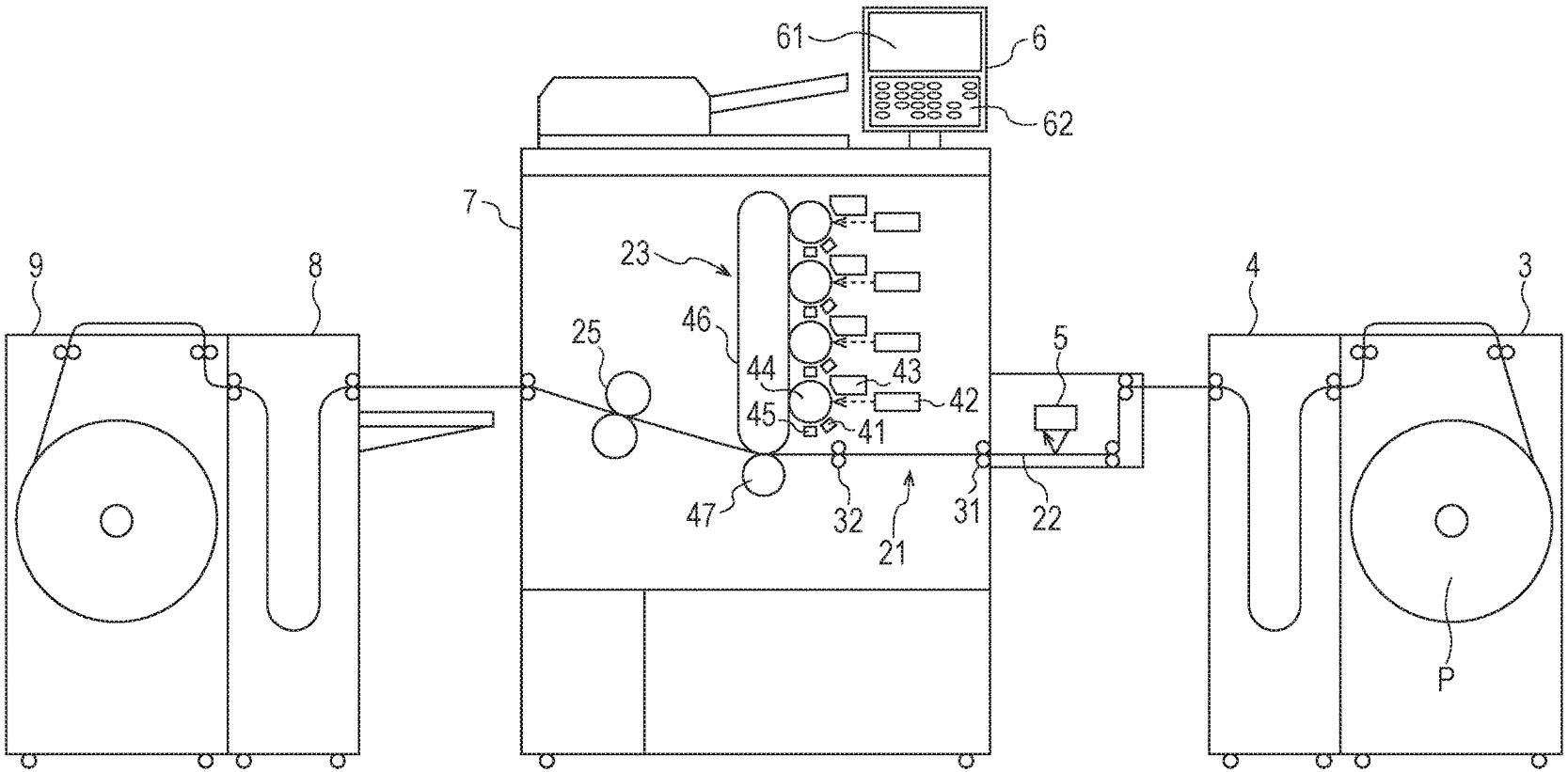
FIG. 1 is a diagram illustrating an exemplary overall configuration of an image forming apparatus according to an embodiment of the present disclosure.

FIG. 1 is a diagram illustrating an exemplary overall configuration of an image forming apparatus 1 according to the embodiment of the present disclosure. As illustrated in FIG. 1, the image forming apparatus 1 includes an image forming apparatus main body 7, a paper feed adjuster 4 is coupled to a preceding stage side of the image forming apparatus main body 7, and a paper feeder 3 is coupled to a preceding stage side of the paper feed adjuster 4. A detector 5 is provided between the image forming apparatus main body 7 and the paper feed adjuster 4. The detector 5 detects a mark M on continuous paper P conveyed by a conveyer 21. Details of the mark M on the continuous paper P will be described later. A winding adjuster 8 is coupled to a paper ejection side of the image forming apparatus main body 7, and a winder 9 is coupled to a paper ejection side of the winding adjuster 8. The paper feeder 3 has functions of storing and holding the continuous paper P and feeding it to the image forming apparatus main body 7. The continuous paper P is, for example, roll paper. The winder 9 has a function of holding the continuous paper P ejected from the image forming apparatus main body 7. The paper feed adjuster 4 has a buffer function for absorbing a minute speed difference and deviation between the paper feeder 3 and the image forming apparatus main body 7. The winding adjuster 8 has a buffer function for absorbing a minute speed difference and deviation between the winder 9 and the image forming apparatus main body 7.

In the image forming apparatus 1, an image former 23 that forms an image I on the continuous paper P is provided inside the image forming apparatus main body 7, and a setting unit 6 is provided on the image forming apparatus main body 7. The setting unit 6 includes a display 61 and an operation part 62. For example, various settings of printing operation can be performed using the setting unit 6 that accepts operation of an operator via the operation part 62 and displays information on the display 61. In addition, an automatic document feeder that automatically reads a document and a document image scanner are provided on the image forming apparatus main body 7. The document image scanner is capable of reading the image I through platen glass. For example, the document image scanner reads the document image I to store it in an image memory (not illustrated) or the like, which is used for forming the image I by the image former 23. The image former 23 is provided on a subsequent stage side of the detector 5, and includes photoconductors 44 prepared for colors such as cyan, magenta, yellow, black, and the like, respectively. A charging device 41, an exposing device 42, and a developing device 43 are provided around each of the photoconductors 44.

A surface of the photoconductor 44 charged by the charging device 41 is subject to image exposure using the exposing device 42 on the basis of the document image information stored in the image memory or the like, thereby forming an electrostatic latent image. The electrostatic latent image is developed by the developing device 43 to be a toner image. The toner image is transferred to an intermediate transfer belt 46. The toner image transferred to the intermediate transfer belt 46 is transferred to the continuous paper P conveyed by the conveyer 21 through a conveying path 22 while being compressed by a secondary transfer roller 47. The conveyer 21 includes various rollers such as a conveying roller 31 and a registration roller 32. The toner image compressed and transferred by the secondary transfer roller 47 is heated and pressed by a fixing unit 25 to be fixed on the continuous paper P. That is, the image former 23 causes the image I to be transferred to the continuous paper P by performing image formation according to the electrophotographic process. A drum cleaner 45 is provided around the photoconductor 44. The drum cleaner 45 removes residual toner remaining on the intermediate transfer belt 46. The conveying path 22 feeds and conveys the continuous paper P. In the conveying path 22, the continuous paper P stored in the paper feeder 3 is fed, and the continuous paper P is conveyed to the image former 23 via the conveying roller 31 and the registration roller 32.

Figure 2:
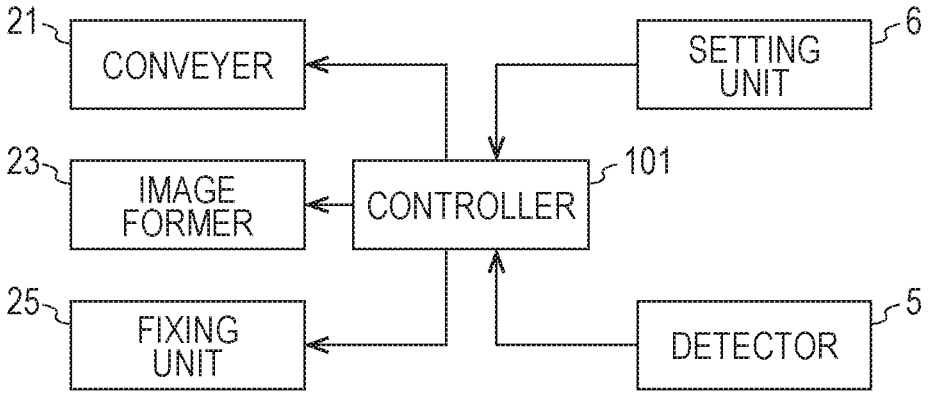
FIG. 2 is a diagram illustrating an exemplary functional configuration of the image forming apparatus according to the embodiment of the present disclosure.

FIG. 2 is a diagram illustrating an exemplary functional configuration of the image forming apparatus 1 according to the embodiment of the present disclosure. A controller 101 includes a CPU, a ROM, a RAM, a storage unit (not illustrated), and the like. The CPU reads, from the ROM, a program corresponding to processing details, loads the program into the RAM, and controls operation of the image forming apparatus 1 in cooperation with the loaded program. The storage unit is implemented by a nonvolatile semiconductor memory such as a flash memory or a hard disk drive, and stores various data. The various data stored in the storage unit is referred to when the CPU controls the operation of the image forming apparatus 1. Specifically, the controller 101 causes the image former 23 to start forming the image I in accordance with a position setting for causing the image former 23 to write the image I after detecting the mark M on the continuous paper P. The controller 101 causes the image I to be written from, as such a position setting, a start position determined according to the image formation state on the basis of the mark M detected by the detector 5. Details of the processing will be described later.

Figure 3:
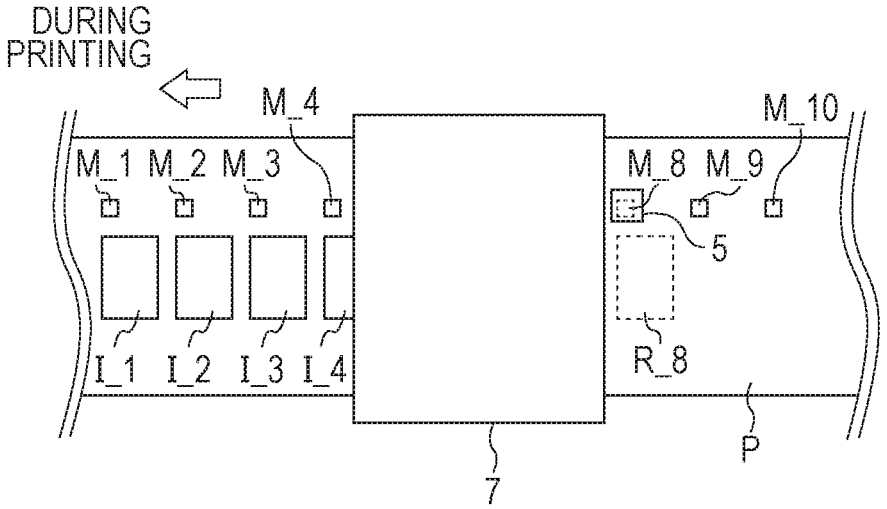
FIG. 3 is a diagram illustrating an operation outline of overprinting according to the embodiment of the present disclosure.

FIG. 3 is a diagram illustrating an operation outline of overprinting according to the embodiment of the present disclosure. In the overprinting, the image I is formed by performing timing control as control for forming the image I from the start position at each time the detector 5 detects the mark M. In the example in FIG. 3, marks M_1 to M_10 are formed on the continuous paper P at constant intervals. In a case where any of the marks M_1 to M_10 is not specified, it is referred to as a mark M. The image I is formed at each time the mark M is detected by the detector 5. For example, images I_1 to I_4 correspond to marks M_1 to M_4, respectively. As illustrated in FIG. 3, an image formation scheduled region R_8 is a region in which an image I_8 is formed. For example, the image I_8 is formed by the image forming apparatus main body 7 by a mark M_8 being detected by the detector 5.

Figure 4:
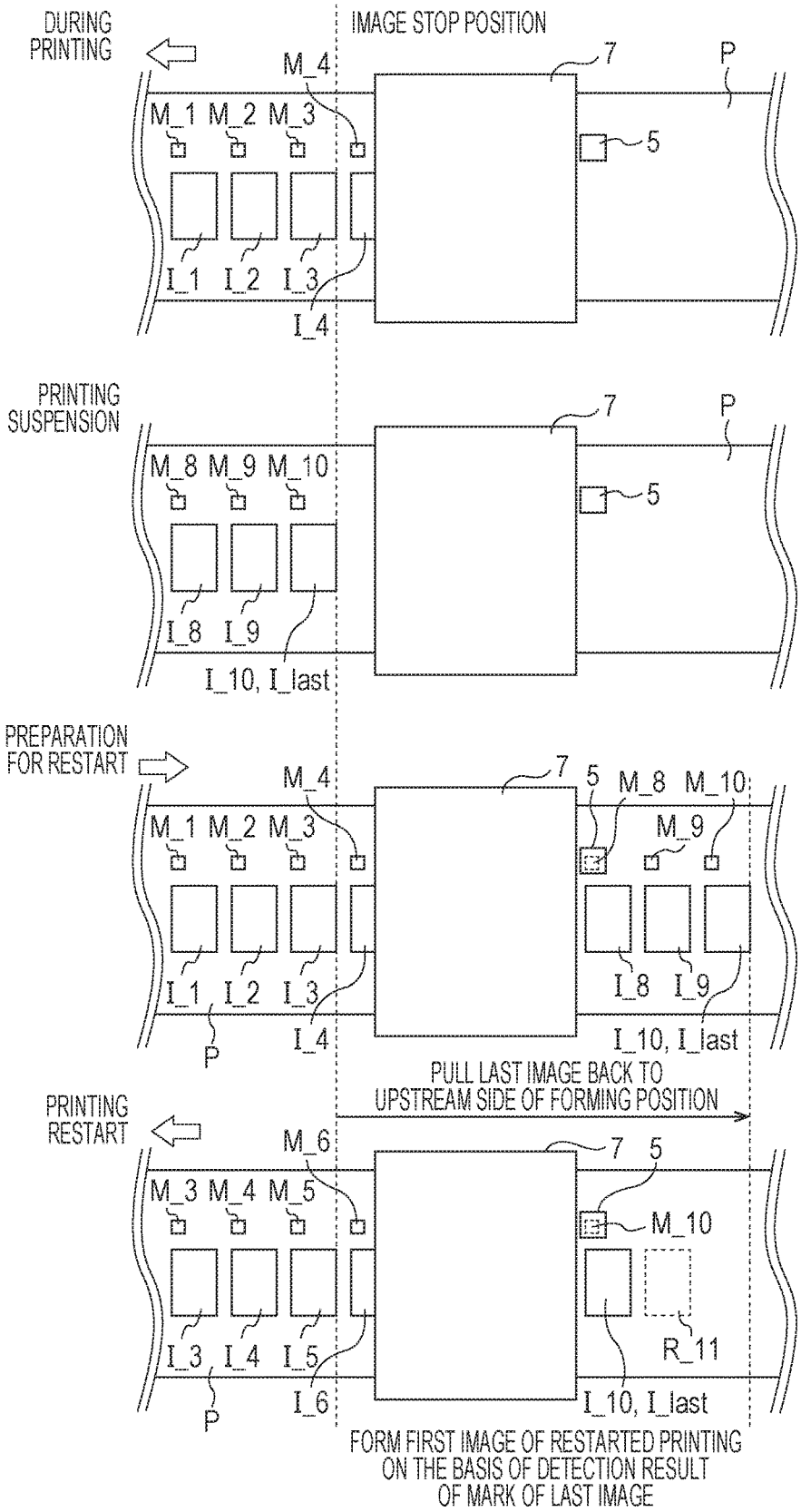
FIG. 4 is a diagram illustrating an operation outline of post-suspension restart printing according to the embodiment of the present disclosure.

FIG. 4 is a diagram illustrating an operation outline of post-suspension restart printing according to the embodiment of the present disclosure. In the post-suspension restart printing, for example, the image I is formed by performing timing control as control for writing the image I from the start position of a first image of restart printing on the basis of a detection result of the mark M of a last image I_last that has already been printed, which is detected by the detector 5. In the example of FIG. 4, printing has been successively performed from the image I_1, and the printing is suspended at the time point at which an image I_10 is printed. Therefore, the last image I_last is the image I_10, and the mark M corresponding to the image I_10 is the mark M_10. In this case, the image I_10, which is the last image I_last, is pulled back to an upstream side of the start position at which the image I_10 is formed as preparation for restart printing, and the printing is restarted. Specifically, a position of an image formation scheduled region R_11 is determined on the basis of the mark M_10. That is, the first image of the restarted printing is formed on the basis of the detection result of the mark M_10 corresponding to the image I_10 that is the last image I_last.

Figure 5:
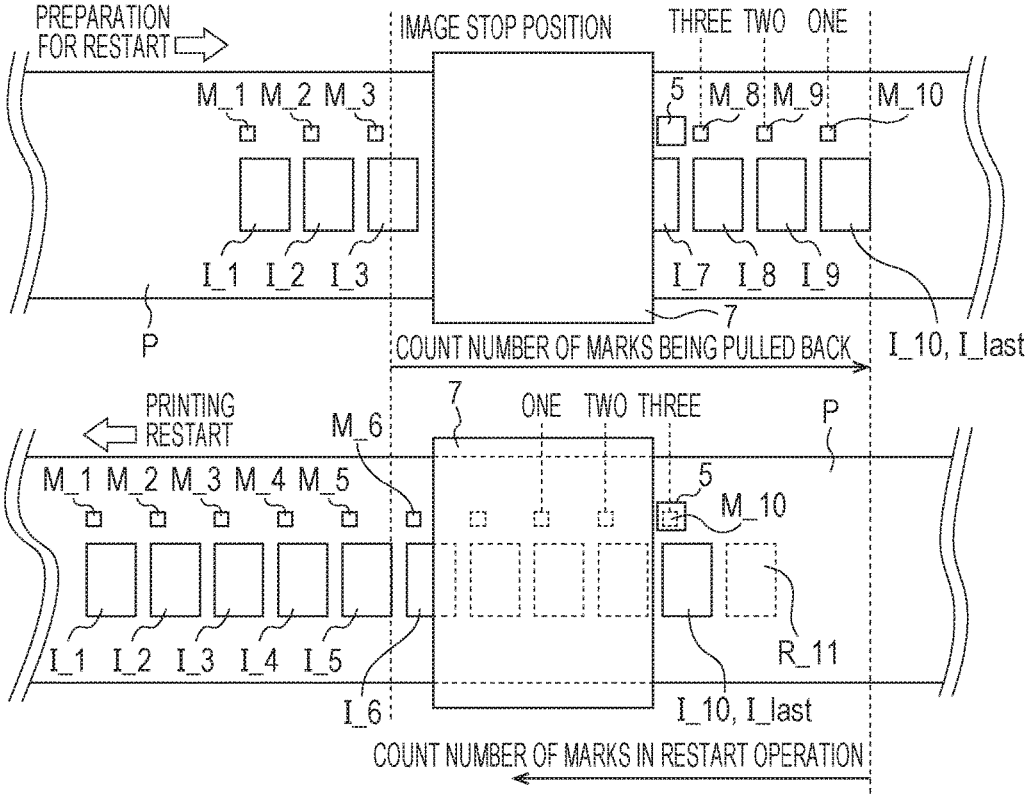
FIG. 5 is a diagram illustrating exemplary operation for determining a last image by counting the number of marks according to the embodiment of the present disclosure.
Figure 6:
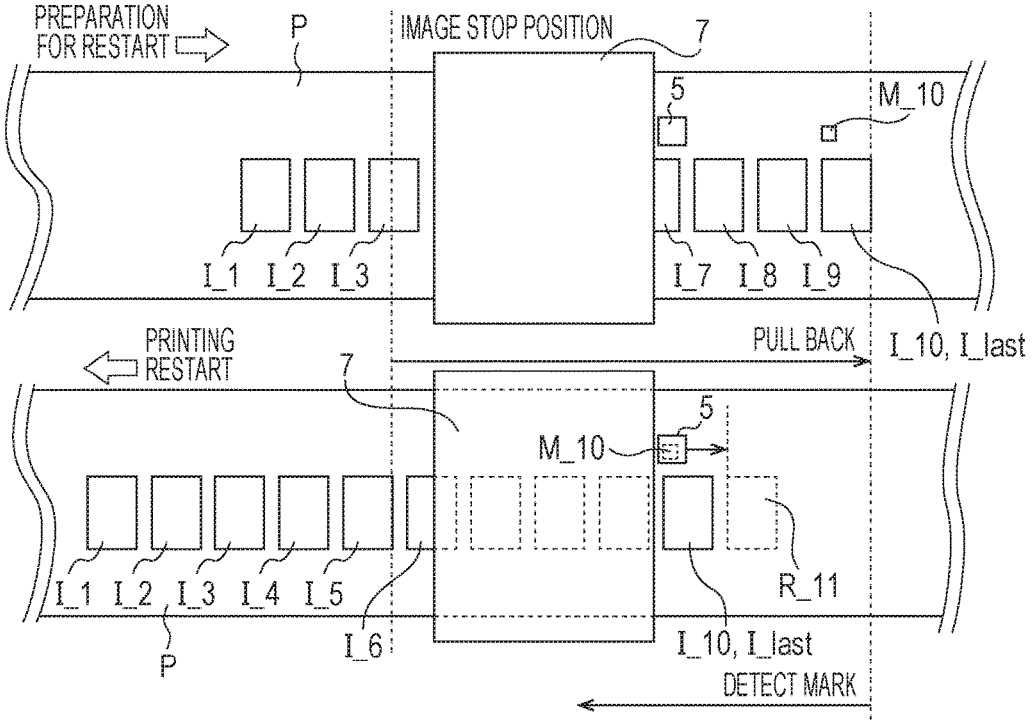
FIG. 6 is a diagram illustrating exemplary operation for determining the last image by printing the mark only for the last image according to the embodiment of the present disclosure.
Figure 7:
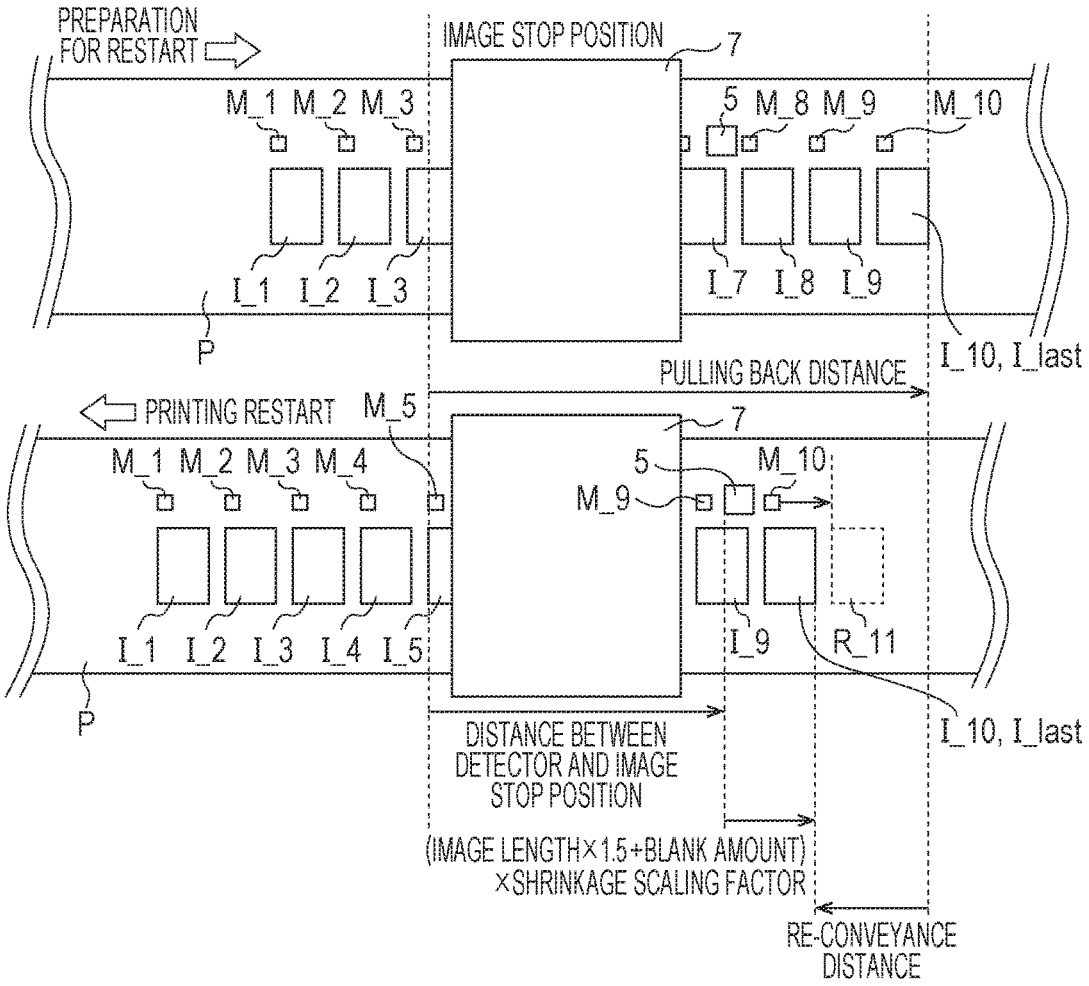
FIG. 7 is a diagram illustrating exemplary operation for determining the last image with a first image in which the mark is detected after a re-conveyance distance at the start of a post-suspension restart printing exceeds a preset distance according to the embodiment of the present disclosure.

An example of determining the last image I_last will be described with reference to FIGS. 5 to 7. FIG. 5 is a diagram illustrating exemplary operation for determining the last image I_last by counting the number of marks M according to the embodiment of the present disclosure. In the example in FIG. 5, the number of marks M while the continuous paper P is being pulled back is counted, and the number of marks M during restart operation is counted. In a case where the number of marks M during the pullback matches the number of marks M during the restart operation, it is determined that the image I corresponding to the mark M at that time is the last image I_last. FIG. 6 is a diagram illustrating exemplary operation for determining the last image I_last by printing the mark M only for the last image I according to the embodiment of the present disclosure. In the example in FIG. 6, the mark M is printed only when the last image I_last is printed. In a case where the mark M is detected at the time of reprinting, it is determined that the image I corresponding to the mark M at that time is the last image I_last. FIG. 7 is a diagram illustrating exemplary operation for determining the last image I_last with a first image I in which the mark M is detected after a reconveyance distance at the start of the post-suspension restart printing exceeds a preset distance according to the embodiment of the present disclosure. The preset distance is expressed by the following formula (1).

$$\text{Preset distance}=\text{Pullback distance}-\{\text{Distance between detector 5 and image stop position}+(\text{Image length}\times 1.5+\text{Blank amount})\times\text{Shrinkage scaling factor}\} \quad (1)$$

The image length is a length in the conveying direction of the continuous paper P. The blank amount is, for example, 1 mm. A coefficient for ensuring that a preceding mark M passes through the detector 5 is indicated by the numeral 1.5, which is not limited thereto.

Figure 8:
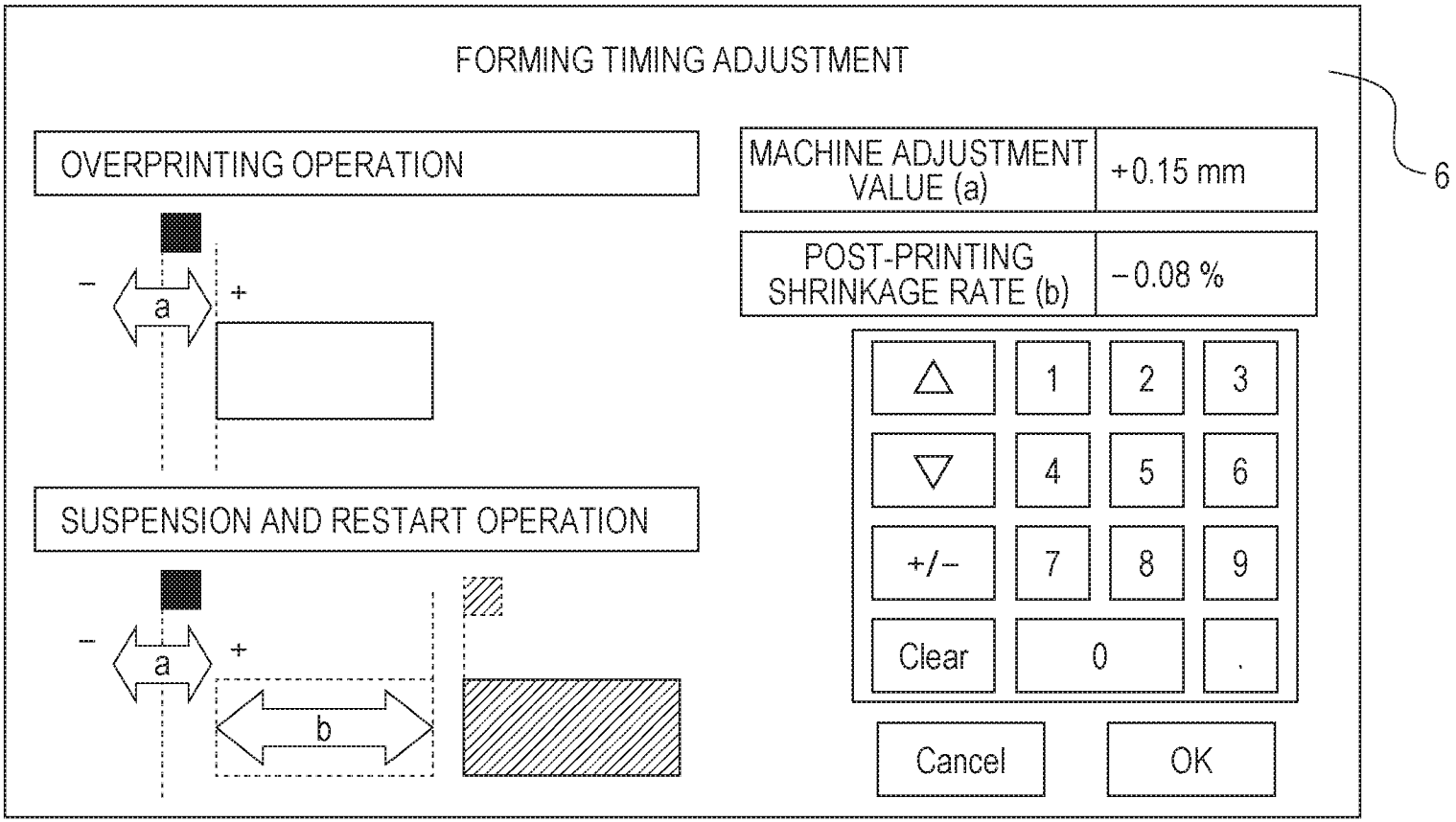
FIG. 8 is a view illustrating an exemplary setting screen displayed on a display according to the embodiment of the present disclosure.
Figure 9:
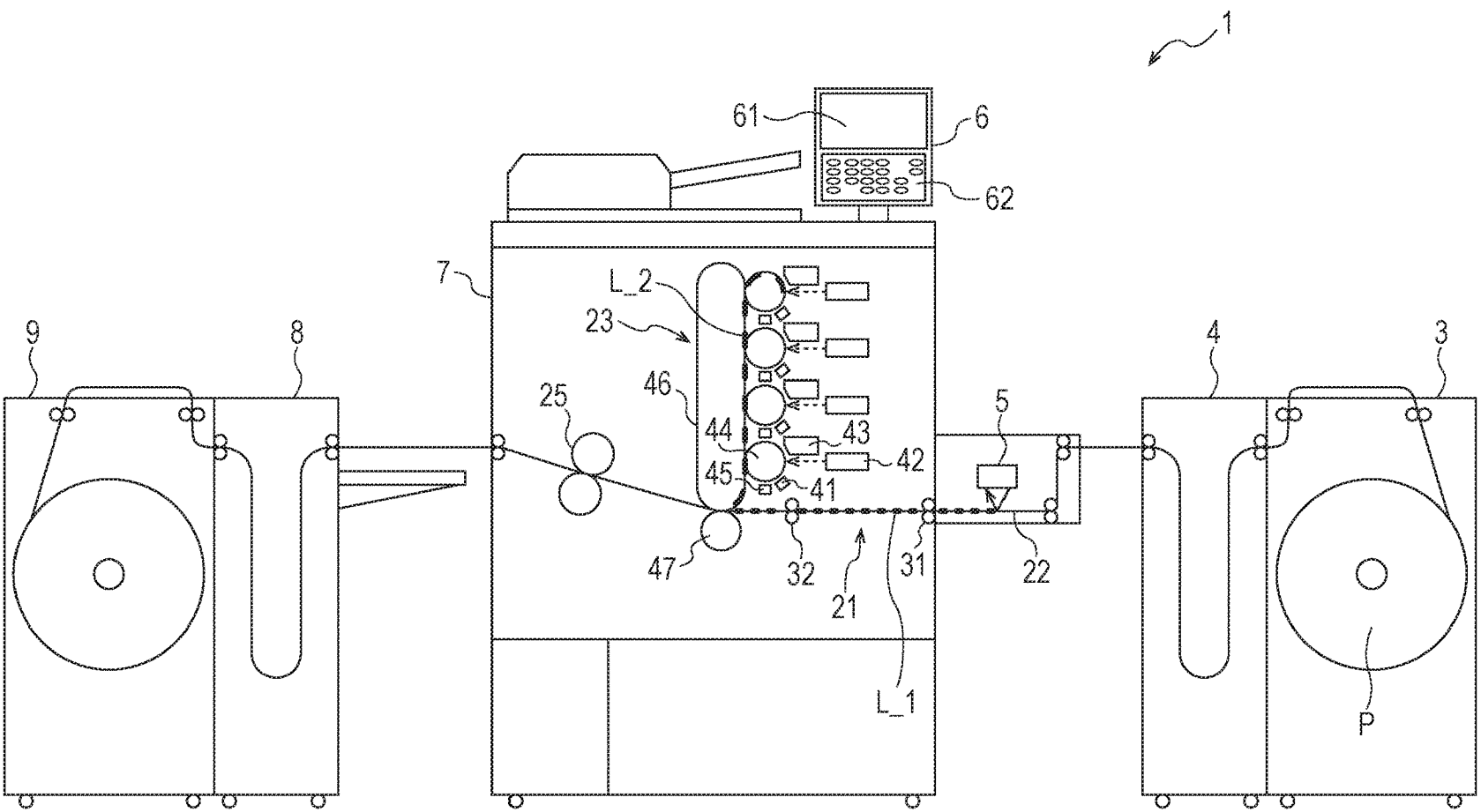
FIG. 9 is a diagram illustrating a first path length and a second path length according to the embodiment of the present disclosure.

FIG. 8 is a view illustrating an exemplary setting screen displayed on the setting unit 6 according to the embodiment of the present disclosure. FIG. 9 is a diagram illustrating a first path length L_1 and a second path length I_2 according to the embodiment of the present disclosure. In FIG. 8, an exemplary case where the setting unit 6 is configured as a liquid crystal touch panel display, for example, is illustrated. A machine adjustment value a is set as a parameter that cancels the influence of deviation of the position setting for forming the image I by the structure of at least one of the conveying path 22 and the image former 23. A formation timing is adjusted so that the formation of the image I by the image former 23 is started after the elapse of a set time corresponding to a set distance Lw from the detection of the mark M by the detector 5.

A first set value is set as a control parameter for the overprinting. Specifically, it is expressed by the following formula (2).

$$\text{Set distance } Lw=\text{First path length } L_1-\text{Second path length } L_2+\text{Machine adjustment value } a \quad (2)$$

The set distance Lw expressed by the formula (2) in this case is the first set value. In an overprinting mode, formation of the image I is started after the elapse of the set time corresponding to the first set value at each time the detector 5 detects the mark M. The set time corresponding to the first set value may be obtained on the basis of the set distance Lw and a linear speed at which the continuous paper P is conveyed. The first path length L_1 is a length from, along the conveying path 22, a detection position of the continuous paper P detected by the detector 5 to a transfer position at which the image I is transferred on the continuous paper P. The second path length L_2 is a length from the position at which the electrostatic latent image is formed in the image former 23 to the transfer position at which the image I is transferred on the continuous paper P. That is, the first set value is a control parameter for the overprinting, which is a value obtained by adding the machine adjustment value a to the difference between the first path length L_1 and the second path length L_2.

A post-printing shrinkage rate b is set as a parameter representing the influence of shrinkage of the continuous paper P when the continuous paper P shrinks due to heat with the image I being fixed onto the continuous paper P. A second set value is set as a control parameter for the post-suspension restart printing. Specifically, it is expressed by the following formula (3).

$$\text{Set distance } Lw=\text{First path length } L_1-\text{Second path length } L_2+\text{Blank amount between images } I+(\text{Machine adjustment value } a+\text{Image length})\times(1.00+\text{Post-printing shrinkage rate } b) \quad (3)$$

The set distance Lw expressed by the formula (3) in this case is the second set value. In a normal print mode, formation of the image I is started after the elapse of the set time corresponding to an image interval in which the blank amount between the images I and the image length are added. The blank amount between the images I is, for example, 1 mm. The image length is a length per image in the conveying direction of the continuous paper P. That is, the second set value is a control parameter for the post-suspension restart printing, which is a value obtained on the basis of the length of the image formed on the continuous paper P in the conveying direction of the continuous paper P and the post-printing shrinkage rate b.

According to the descriptions above, with respect to a second and subsequent images after the print restart, the image I may be formed at a timing according to the print mode. The controller 101 causes the image I to be written from the start position determined according to the image formation state on the basis of the mark M detected by the detector 5. The image formation state is determined according to at least one of the first set value and the second set value. The controller 101 controls at least one of the overprinting and the post-suspension restart printing. In the overprinting, an image formation position for each time is set as a position setting on the basis of the first set value. In the post-suspension restart printing, a first image formation position at the time of restarting printing is set as a position setting on the basis of the second set value.

Specifically, in a case where the overprinting is executed, the controller 101 adjusts the start position for forming the image I according to the position of the mark M detected by the detector 5 and the first set value at each time the image I is formed on the continuous paper P. In a case where the post-suspension restart printing is executed, the controller 101 adjusts the start position for forming the image I according to a position of the latest mark M among the marks M detected by the detector 5 and the second set value. In a case where the post-suspension restart printing is executed under execution of the overprinting, the controller 101 adjusts the start position for forming the image I according to the position of the mark M detected by the detector 5 and the first set value at each time the image I is formed on the continuous paper P. The controller 101 controls the start position at which the image I is formed according to the formation timing for forming the image I on the continuous paper P. Specifically, the controller 101 sets the timing in which the elapsed time from when the mark M is detected by the detector 5 is equal to or more than a predetermined set time as the formation timing. As described above, the set time can be easily obtained from the set distance Lw.

Figure 10:
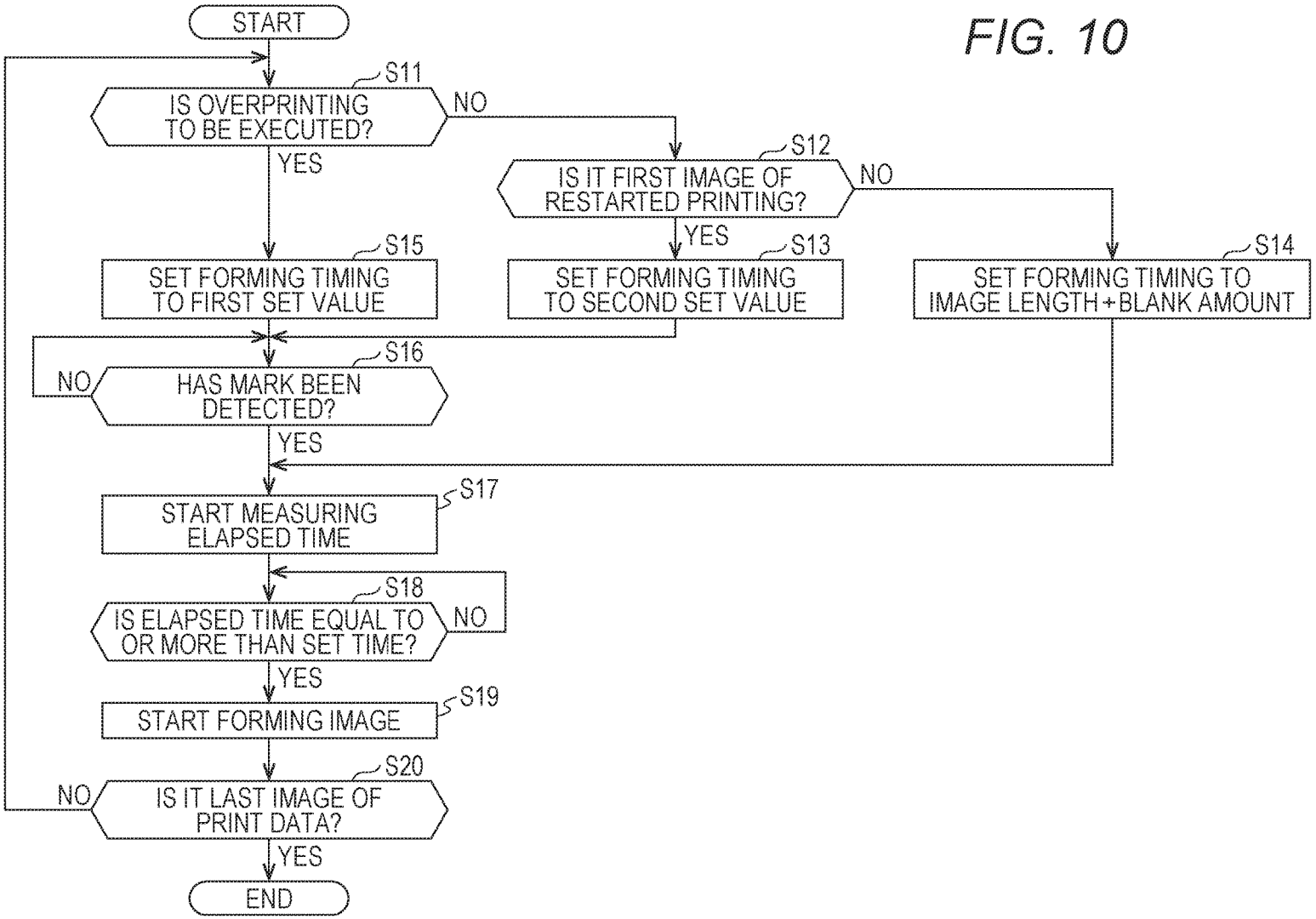
FIG. 10 is a flowchart illustrating exemplary control based on a formation timing for describing an exemplary control according to the embodiment of the present disclosure.

FIG. 10 is a flowchart illustrating exemplary control based on the formation timing for describing an exemplary control according to the embodiment of the present disclosure. In step S11, the controller 101 determines whether to execute the overprinting. In a case where the controller 101 determines to execute the overprinting (Y in step S11), the process proceeds to step S15. In a case where the controller 101 determines not to execute the overprinting (N in step S11), the process proceeds to step S12. In step S12, the controller 101 determines whether it is the first image of the restarted printing. In a case where the controller 101 determines that it is the first image of the restarted printing (Y in step S12), the process proceeds to step S13. In a case where the controller 101 determines that it is not the first image of the restarted printing (N in step S12), the process proceeds to step S14. In step S13, the controller 101 sets the formation timing to the second set value, and the process proceeds to step S16. In step S14, the controller 101 sets the formation timing to the image length+the blank amount, and the process proceeds to step S17. In step S15, the controller 101 sets the formation timing to the first set value, and the process proceeds to step S16. In step S16, the controller 101 determines whether the mark M has been detected. In a case where the controller 101 determines that the mark M has been detected (Y in step S16), the process proceeds to step S17. In a case where the controller 101 determines that the mark M is not detected (N in step S16), the processing in step S16 continues. In step S17, the controller 101 starts measuring the elapsed time. The measurement of the elapsed time is started after the detector 5 detects the mark M. In step S18, the controller 101 determines whether the elapsed time is equal to or more than the set time. The set time is a time corresponding to the first set value or the second set value. In a case where the controller 101 determines that the elapsed time is equal to or more than the set time (Y in step S18), the process proceeds to step S19. In a case where the controller 101 determines that the elapsed time is less than the set time (N in step S18), the processing in step S18 continues. In step S19, the controller 101 starts forming the image I. In step S20, the controller 101 determines whether it is the last image I_last of the print data. In a case where the controller 101 determines that it is the last image I_last of the print data (Y in step S20), the process is terminated. In a case where the controller 101 determines that it is not the last image I_last of the print data (N in step S20), the process returns to step S11.

Incidentally, in a case where printing or processing on the continuous paper P is performed, it is required to keep intervals of the image I on the continuous paper P constant to efficiently perform various kinds of processing. It is common to dispose the mark M on the continuous paper P and adjust the formation timing of the image I on the continuous paper P on the basis of the detection timing of the mark M. Such adjustment of the formation timing is mainly used for timing adjustment at the time of performing the overprinting on the continuous paper P having been subject to printing or processing in advance and timing adjustment at the time of restarting printing operation having been suspended by any reason.

Here, in the case of the overprinting operation, it is common that a region requiring the overprinting has already undergone printing or processing as groundwork, and the formation timing is controlled at each time the mark M is detected to form the image I. Meanwhile, in the case of print restart operation such as the post-suspension restart printing, after the printing operation of the image forming apparatus 1 is suspended, the continuous paper P is pulled back to perform the printing. Therefore, it is common that the timing control of the first image of the restart printing is performed on the basis of the detection result of the mark M corresponding to the last image I_last that has already been printed by the image forming apparatus 1 to form the first image.

However, the continuous paper P shrinks through the fixing in a method of printing in which the image I is fixed by heat, such as an electrophotographic method. Accordingly, it is known that the image length on the continuous paper P changes at a constant rate depending on a type of the continuous paper P. Therefore, depending on the method of printing, it is necessary to separately control the formation timing control of the image I in the overprinting operation and the formation timing control of the image I in the print restart operation, which has been troublesome for a user.

In view of the above, in the present embodiment, the position setting is adjusted on the basis of the start position determined according to the image formation state. Accordingly, the position setting can be finely adjusted depending on the image formation state. Therefore, even when the continuous paper P shrinks through the fixing, the image I can be formed at an appropriate position.

Further, according to the present embodiment, the image formation position for each time is set on the basis of the first set value in the overprinting. In the post-suspension restart printing, the first image formation position at the time of restarting printing is set on the basis of the second set value. Accordingly, the overprinting operation is controlled on the basis of the first set value, and the post-suspension restart printing operation is controlled on the basis of the second set value. Therefore, the overprinting operation and the post-suspension restart printing operation can be clearly discriminated.

Furthermore, according to the present embodiment, in a case where the overprinting is executed, the start position is adjusted according to the position of the mark M detected by the detector 5 and the first set value at each time the image I is formed on the continuous paper P. Accordingly, the formation position of the image I at each time is adjusted by the existing mark M and the first set value. Therefore, the position of the overprinting can be accurately adjusted with a simple setting.

Furthermore, according to the present embodiment, in a case where the post-suspension restart printing is executed, the start position is adjusted according to the position of the latest mark M among the marks M detected by the detector 5 and the second set value. Accordingly, the formation position of the first image I of the restart printing is adjusted by the latest mark M and the second set value. Therefore, even when the continuous paper P shrinks through the fixing, the position of the post-suspension restart printing can be accurately adjusted with a simple setting.

Furthermore, according to the present embodiment, in a case where the post-suspension restart printing is executed under the execution of the overprinting, the start position is adjusted according to the position of the mark M detected by the detector 5 and the first set value at each time the image I is formed on the continuous paper P. Accordingly, even when the post-suspension restart printing is executed, the formation position of the image I at each time is adjusted by the existing mark M and the first set value at the time of executing the overprinting. Therefore, the position of the overprinting with the post-suspension restart printing can be accurately adjusted with a simple setting.

Furthermore, according to the present embodiment, the first set value is a value obtained by adding the machine adjustment value a to the difference between the first path length L_1 from, along the conveying path 22, the detection position of the continuous paper P detected by the detector 5 to the transfer position at which the image I is transferred on the continuous paper P and the second path length L_2 from the position at which the electrostatic latent image is formed in the image former 23 to the transfer position. Accordingly, the first set value is a parameter that can be adjusted by adjusting only the machine adjustment value a without considering the first path length L_1 and the second path length L_2. Therefore, the start position of the formation of the image I in the overprinting can be easily adjusted.

Furthermore, according to the present embodiment, the second set value is a value obtained on the basis of the length of the image formed on the continuous paper P in the conveying direction of the continuous paper P and the post-printing shrinkage rate b that is a parameter representing the influence of shrinkage of the continuous paper P of a case where the continuous paper P shrinks due to heat with the image I being fixed onto the continuous paper P. The image interval can be obtained from the image length and the post-printing shrinkage rate b. Accordingly, the second set value can be obtained from the image interval in which the shrinkage alter printing is considered using the post-printing shrinkage rate b. Therefore, the start position of the formation of the image I in the post-suspension restart printing can be easily adjusted.

Furthermore, according to the present embodiment, the start position of the formation of the image I is controlled according to the formation timing of forming the image I on the continuous paper P. Accordingly, the start position of the formation of the image I can be controlled with the time serving as a trigger. Therefore, the start position of the formation of the image I can be easily controlled.

Furthermore, according to the present embodiment, the timing in which the elapsed time from when the mark M is detected by the detector 5 is equal to or more than the predetermined set time is set as a formation timing of forming the image I on the continuous paper P. The elapsed time is measured after the mark M is detected by the detector 5. Therefore, the start position of the formation of the image I can be adjusted according to a conveying speed of the continuous paper P, whereby fine adjustment of the formation start position of the image I can be facilitated.

The image forming apparatus 1 according to the present disclosure has been described on the basis of the embodiment. It should be noted that the present disclosure is not limited thereto, and modifications may be made without departing from the gist of the present disclosure.

For example, although the exemplary case where the continuous paper P is roll paper has been described in the present embodiment, it is not particularly limited thereto. For example, the continuous paper P may be a slip sheet or a long paper sheet. In other words, the continuous paper P may be any paper as long as it is continuous over a certain range. For example, the continuous paper P may be fed in an alternately bent form. Besides, although the exemplary case where the setting unit 6 includes the display 61 and the operation part 62 has been described, it is not particularly limited thereto. For example, the display 61 and the operation part 62 may be integrally configured like a liquid crystal touch panel display.

Furthermore, in the present embodiment, the exemplary case where the image forming apparatus 1 includes the paper feeder 3, the paper feed adjuster 4, the image forming apparatus main body 7, the winding adjuster 8, and the winder 9 has been described, it is not particularly limited thereto. For example, the image forming apparatus 1 may include only the image forming apparatus maul body 7. Besides, although the description is omitted in the present embodiment, a post-processing device that performs post-processing such as lamination and cutting may be coupled. The post-processing device may be included in the image forming apparatus main body 7, the post-processing device may be coupled to the image forming apparatus main body 7 to form the image forming apparatus 1, and the post-processing device may be coupled to the image forming apparatus 1 to form an image forming system.

Furthermore, the exemplary case where the timing control is performed as control for causing the image I to be formed from the start position at which the image I is formed has been described in the present embodiment, it is not particularly limited thereto. For example, control may be performed such that the image I is formed from the start position at which the image I is formed by a conveyance distance of the continuous paper P.

Although embodiments of the present invention have been described and illustrated in detail, the disclosed embodiments are made for purposes of illustration and example only and not limitation. The scope of the present invention should be interpreted by terms of the appended claims.

What is claimed is:

1. An image forming apparatus, comprising:

a conveyer that conveys continuous paper through a conveying path;

a detector that detects a mark on the continuous paper conveyed by the conveyer;

an image former that is provided on a subsequent stage side of the detector and forms an image on the continuous paper; and a hardware processor that causes the image former to start forming an image according to a position setting for forming an image on the continuous paper using the image former after a mark on the continuous paper is detected, wherein the hardware processor adjusts the position setting on the basis of a start position determined according to an image formation state.

2. The image forming apparatus according to claim 1, wherein the image formation state is a state in which an overprinting or a post-suspension restart printing is performed, a first set value is set as a control parameter for the overprinting, a second set value is set as a control parameter for the post-suspension restart printing, the hardware processor controls at least one of the overprinting and the post-suspension restart printing, an image formation position each time is set on the basis of the first set value in the overprinting, and a first image formation position at a time of print restart is set on the basis of the second set value in the post-suspension restart printing.

3. The image forming apparatus according to claim 2, wherein in a case where the hardware processor causes the overprinting to be executed, the hardware processor adjusts the start position according to a position of a mark detected by the detector and the first set value at each time an image is formed on the continuous paper.

4. The image forming apparatus according to claim 2, wherein in a case where the hardware processor causes the post-suspension restart printing to be executed, the hardware processor adjusts the start position according to a position of a latest mark among marks detected by the detector and the second set value.

5. The image forming apparatus according to claim 2, wherein in a case where the hardware processor causes the post-suspension restart printing to be executed under execution of the overprinting, the hardware processor adjusts the start position according to a position of a mark detected by the detector and the first set value at each time an image is formed on the continuous paper.

6. The image forming apparatus according to claim 2, wherein a machine adjustment value is set as a parameter that cancels influence of deviation of the position setting by a structure of at least one of the conveying path and the image former, and the first set value is a value obtained by adding the machine adjustment value to a difference between a first path length from a detection position of the continuous paper detected by the detector to a transfer position at which an image is transferred on the continuous paper along the conveying path and a second path length from a position at which an electrostatic latent image is formed in the image former to the transfer position.

7. The image forming apparatus according to claim 2, wherein a post-printing shrinkage rate is set as a parameter representing influence of shrinkage of the continuous paper when the continuous paper shrinks due to heat with an image being fixed on the continuous paper, and the second set value is a value obtained on the basis of a length of an image formed on the continuous paper in a conveying direction of the continuous paper and the post-printing shrinkage rate.

8. The image forming apparatus according to claim 1, wherein the hardware processor controls the start position according to a formation timing for forming an image on the continuous paper.

9. The image forming apparatus according to claim 8, wherein the hardware processor sets a timing in which an elapsed time from when the mark is detected by the detector is equal to or more than a predetermined set time as the formation timing.

* * * * *